US006946953B2

(12) United States Patent
Lesesky et al.

(10) Patent No.: US 6,946,953 B2
(45) Date of Patent: Sep. 20, 2005

(54) APPARATUS AND METHOD FOR ENHANCED DATA COMMUNICATIONS AND CONTROL BETWEEN A VEHICLE AND A REMOTE DATA COMMUNICATIONS TERMINAL

(75) Inventors: Alan Lesesky, Charlotte, NC (US); Bobby Ray Weant, Rock Hill, SC (US)

(73) Assignee: Vehicle Enhancement Systems, Inc., Rock Hill, SC (US)

( * ) Notice: Subject to any disclaimer, the term of this patent is extended or adjusted under 35 U.S.C. 154(b) by 614 days.

(21) Appl. No.: 10/158,581

(22) Filed: May 30, 2002

(65) Prior Publication Data

US 2003/0222770 A1 Dec. 4, 2003

(51) Int. Cl.[7] ..... G08B 21/00

(52) U.S. Cl. ..... 340/431; 340/825.69; 340/825.72; 370/913; 701/47

(58) Field of Search ..... 340/431, 933, 340/825.69, 825.72, 825.71, 825.73, 10.1; 701/1, 29, 33, 36, 47, 45; 235/384; 370/912, 913; 455/39

(56) References Cited

U.S. PATENT DOCUMENTS

| | | | | |
|---|---|---|---|---|
| 4,996,719 | A | 2/1991 | Okazaki et al. | |
| 5,081,667 | A | 1/1992 | Drori et al. | |
| 5,488,352 | A | 1/1996 | Jasper | 340/431 |
| 5,524,034 | A | 6/1996 | Srygley et al. | |
| 5,677,667 | A | 10/1997 | Lesesky et al. | 340/431 |

(Continued)

FOREIGN PATENT DOCUMENTS

| | | |
|---|---|---|
| EP | 0 802 082 A2 | 10/1997 |
| WO | WO 97/17232 | 5/1997 |
| WO | WO 97/28988 | 8/1997 |
| WO | WO 9728988 | 8/1997 |
| WO | WO 98/34812 | 8/1998 |
| WO | WO 99/06987 | 2/1999 |
| WO | WO 99/35009 | 7/1999 |

*Primary Examiner*—Davetta W. Goins
(74) *Attorney, Agent, or Firm*—Bracewell & Patterson, LLP; Jeffrey S. Whittle

(57) ABSTRACT

An apparatus and methods for enhanced data communications and control between a vehicle and a remote data communications terminal are disclosed. The apparatus preferably includes a first protocol converter adapted to be positioned in communication with at least one electronic subsystem of the vehicle, a first transceiver, a first requestor, and a first buffer. The apparatus also preferably includes a second transceiver, a second protocol converter, a second requestor, and a second buffer. The first protocol converter converts data of a vehicle communication protocol to data of an over-the-air communication protocol. After the first requestor opens a window in an over-the-air communication channel between the vehicle and the remote data communications terminal, the first transceiver in the vehicle wirelessly transmits data over-the-air from the vehicle to the second transceiver in the remote data communications terminal preferably not using the over the air communication protocol. When the vehicle is not transmitting data via the first transceiver, data received from the remote data communication terminal and stored in the first buffer is then transferred to the at least one electronic subsystem of the vehicle. Also, when the remote data communication terminal is not transmitting data via the second transceiver, data received from the vehicle and stored in the second buffer is then transferred to other portions of the remote data communication terminal.

24 Claims, 4 Drawing Sheets

U.S. PATENT DOCUMENTS 5,732,074 A 3/1998 Spaur et al.
5,783,993 A 7/1998 Briski et al.
5,790,536 A 8/1998 Mahany et al.
5,794,164 A 8/1998 Beckert et al.
5,798,577 A 8/1998 Lesesky et al. ..... 307/10.7
5,802,545 A 9/1998 Coverdill
5,822,224 A * 10/1998 Nakanishi et al. ..... 702/174
D403,659 S 1/1999 Lesesky ..... 13/156
D404,170 S 1/1999 Lesesky ..... 26/124
5,884,202 A 3/1999 Arjomand
5,913,180 A * 6/1999 Ryan ..... 702/45
5,917,632 A 6/1999 Lesesky ..... 359/152
6,025,563 A 2/2000 Lesesky et al. ..... 177/136
6,064,299 A 5/2000 Lesesky et al. ..... 340/431
6,089,588 A 7/2000 Lesesky et al. ..... 280/422
6,094,609 A 7/2000 Arjomand
6,111,524 A 8/2000 Lesesky et al. ..... 340/942
6,127,939 A 10/2000 Lesesky et al. ..... 340/825.06
D434,006 S 11/2000 Lesesky et al. ..... 13/147
6,150,793 A 11/2000 Lesesky et al. ..... 320/104
6,254,201 B1 7/2001 Lesesky et al. ..... 303/122.02
6,430,485 B1 8/2002 Hullinger
6,532,416 B1 * 3/2003 Mueller ..... 701/207
6,772,248 B1 8/2004 McClure et al.

* cited by examiner

APPARATUS AND METHOD FOR ENHANCED DATA COMMUNICATIONS AND CONTROL BETWEEN A VEHICLE AND A REMOTE DATA COMMUNICATIONS TERMINAL

BACKGROUND OF THE INVENTION

1. Field of the Invention

The present invention relates to data communication apparatus in general and, in particular, to a data communication apparatus and methods for vehicles.

2. Description of the Prior Art

Vehicles have been commonly utilized to transport passengers and/or cargos over various roadways throughout the United States. For many years, microprocessor-type and microcontroller-type electronic subsystems were simply not found in most vehicles, and particularly not in heavy-duty vehicles such as tractor-trailer combinations. Only in recent years, for example, has the heavy-duty vehicle industry begun to use sophisticated electronic subsystems in tractor-trailer combinations to perform various tasks that involve data manipulations and data transmissions. Much of the sluggishness in technological developments in the heavy-duty vehicle industry could be attributed to the lack of governmental entities or other authoritative initiatives that would have otherwise required sophisticated electronics subsystems be installed on heavy-duty vehicles.

Also, fleets of automobiles, such as security or law enforcement vehicles, customer service delivery vehicles, and postal delivery vehicles, likewise historically had little or no electronic subsystems. Instead, straight voice communication with two-way radios, pagers or more recently cellular telephones have been used. As most vehicles have moved to having an on-board electronic control unit ("ECU"), more electronic subsystems such as vehicle security, engine operations and monitoring, and advanced acoustical systems have been added or expanded.

Today, there are several methods for providing data communications within vehicles also. For example, a specific way of providing data communications between a tractor and a trailer is described in U.S. Pat. No. 5,488,352 titled "*Communications And Control System For Tractor/Trailer And Associated Method*" by Lesesky et al. and which is assigned to the assignee of the present application. As described in the above-mentioned patent, the use of the Society of Automotive Engineering (SAE) standard J1708 and SAE standard J1939 are generally utilized for data communications in the heavy-duty vehicle environment. Additionally, for example, techniques and systems for remotely identifying vehicles have been described in U.S. Pat. No. 6,111,524 titled "*Systems And Methods For Identifying Tractors/Trailers And Components Thereto*" by Lesesky et al., and techniques and systems for over-the-air or through-the-air data communication have been described in U.S. Pat. No. 6,064,299 titled "*Apparatus And Method For Communication Between Heavy Duty Vehicle And Remote Data Communication Terminal*" by Lesesky et al., both of which are also assigned to the same assignee of the present application.

Even though much progress have been recently made in modernizing vehicles, many of the sophisticated electronic subsystems still require extensive retrofitting and/or additions to the vehicles. Thus, many vehicle or fleet owners have been very hesitant in adopting and purchasing sophisticated electronics to upgrade their vehicles because of the high costs and the uncertainty associated with the continuing changes in the electronic technology. Be that as it may, having the ability to monitor and to communicate from any location with the various electronic subsystems associated with a vehicle traveling on the road or positioned at a remote location from a terminal can be beneficial to drivers or passengers, various types of vehicle owners, governmental agencies, and any entity that has a genuine interest in the vehicle industry. Thus, there is still a need for enhanced data communications between a vehicle and a remote data communication terminal.

SUMMARY OF THE INVENTION

In view of the foregoing, the present invention advantageously provides enhanced data communication between a vehicle and a remote terminal. For example, such data communication ability allows a person located at a dispatching facility to monitor the activities of a vehicle traveling on the road via a computer terminal. The present invention also advantageously provides an apparatus and methods for enhanced, over-the air data communications between a vehicle and a remote terminal that allow vehicles to be more readily monitored. The present invention additionally provides an apparatus and method for over-the-air data communication between a vehicle and a remote terminal that compensate for time delay which can occur in some types of over-the-air or through-the-air communications. The present invention further advantageously provides an apparatus and methods for data communication between a vehicle and a remote terminal that reduce the risk of collisions in data or missed data when a vehicle is transmitting data to a remote terminal and the remote terminal is transmitting to the vehicle, and vice-versa. The present invention still further advantageously provides an apparatus and methods for data communication between a vehicle and a remote data terminal that allow the remote terminal to readily receive data in a substantially similar data communication protocol which is used for communication and control within and among electronic subsystems of the vehicle. The present invention also further advantageously provides an apparatus and method for enhanced data communication and control between a vehicle and a remote data terminal so that the present invention can allow vehicle electronic subsystems to be controlled remotely from a remote data communications terminal by providing real time monitoring of the electronic control systems and allow the remote terminal to respond to the functions and operations related to the vehicle.

More particularly, the present invention advantageously provides an apparatus which preferably includes a first protocol converter associated with a vehicle, adapted to be positioned in communication with at least one electronic subsystem of the vehicle, and positioned to convert data from a vehicle communication protocol to data of an over-the-air communication protocol. The apparatus also preferably includes a first requestor associated with the vehicle and positioned to request the opening of an over-the-air communication window in a data communication channel between the vehicle and a remote data communication terminal using the over-the-air communication protocol, a first transceiver associated with the vehicle and in communication with the first requestor to wirelessly transmit data over-the air to the remote data communication terminal and to wirelessly receive data over-the-air from the remote data communication terminal, and a first buffer associated with the vehicle, in communication with the first transceiver and the first protocol converter to receive and temporarily store data communication received from the first transceiver, and positioned to transfer the received data to the first protocol converter and to at least one electronic subsystem when the first transceiver is not transmitting data communication therefrom. The apparatus additionally preferably includes a second transceiver associated with the remote data communication terminal to wirelessly receive data over-the-air from the vehicle and wirelessly transmit data over-the-air to the vehicle, a second protocol converter associated with the remote data communication terminal and in communication with the second transceiver to convert the received data from the over-the-air communication protocol to a remote terminal communication protocol, a second requestor associated with the remote data communication terminal and positioned to request the opening of a window in the data communication channel between the remote data communication terminal and the vehicle using the over-the-air communication protocol, and a second buffer associated with the remote data communication terminal, in communication with the second transceiver and the second protocol converter to receive and temporarily store data communication received from the second transceiver, and positioned to transfer data to the second protocol converter and the remote data communication terminal when the second transceiver is not transmitting data therefrom.

Alternatively, the data can be converted from the over-the-air communication protocol to a remote terminal communication protocol before the data is stored in the remote data communications terminal. The data stored in the buffer preferably is transferred from or extracted from the buffer for further processing when the remote data communications terminal is not transmitting data via the second transceiver.

The present invention also advantageously provides methods for enhanced data communications between a vehicle and a remote data communications terminal. A method preferably includes requesting an opening of a window in an over-the-air communication channel between a vehicle and a remote data communication terminal, wirelessly transmitting data substantially devoid of the over-the-air communication protocol from the vehicle to the remote data communication terminal during the open window in the over-the-air communication channel, temporarily storing data received by the remote data communication terminal, and transferring the temporarily stored data to other portions of the remote data communication terminal responsive to an acknowledgement that the remote data communications terminal is not transmitting any data to the vehicle.

Another method for enhanced data communications between a vehicle and a remote data communications terminal preferably includes requesting to open a window in an over-the-air communication channel between a remote data communication terminal and a vehicle, wirelessly transmitting data substantially devoid of the over-the-air communication protocol from the remote data communication terminal to the vehicle during the open window in the over-the-air communication channel, temporarily storing data received by the vehicle, and transferring the temporarily stored data received by the vehicle to an electronic subsystem associated with the vehicle responsive to an acknowledgement that the vehicle is not transmitting any data to the remote data communications terminal. Additionally, the method can also include receiving the temporarily stored data by the electronic subsystem of the vehicle and responsively changing the condition of the vehicle thru the electronic subsystem by the received data.

The present invention also further provides a computer program product residing on a computer usable medium for providing data communications between an electric subsystem of a vehicle and a remote data communication terminal. The computer program product preferably includes converting means adapted to be positioned in communication with an electronic subsystem of a vehicle for converting data from a vehicle communication protocol to data of an over-the-air communication protocol, requesting means responsive to the converting means for requesting an opening of a window in an over-the-air communication channel between the vehicle and a remote data communications terminal to wirelessly transmit data from the vehicle to a remote data communication terminal, and transferring means responsive to an acknowledgment for transferring data received from the remote data communication terminal to at least one electronic subsystem of the vehicle when the vehicle is not transmitting data to a remote communication terminal.

The ability to monitor and to communicate data from any location with a vehicle traveling on the road or positioned remote from the remote data communication terminal using the present invention can be beneficial to drivers and any entity that has a genuine interest in communicating with vehicles. Such data communication ability advantageously allows a person located at a dispatching facility, for example, to monitor the activities of any vehicle traveling on the road via a remote terminal. The present invention also advantageously allows vehicle electronic subsystems to be controlled remotely from a remote data communications terminal by providing real time monitoring of the electronic control systems and allow the remote terminal to respond to the functions and operations related to the vehicle.

BRIEF DESCRIPTION OF THE DRAWINGS

Some of the features and advantages of the present invention having been stated, others will become apparent as the description proceeds when taken in conjunction with the accompanying drawings, in which.

DETAILED DESCRIPTION

The present invention will now be described more fully hereinafter with reference to the accompanying drawings, in which illustrated embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime numbers, if used, indicate similar elements in alternative embodiments.

Figure 1:
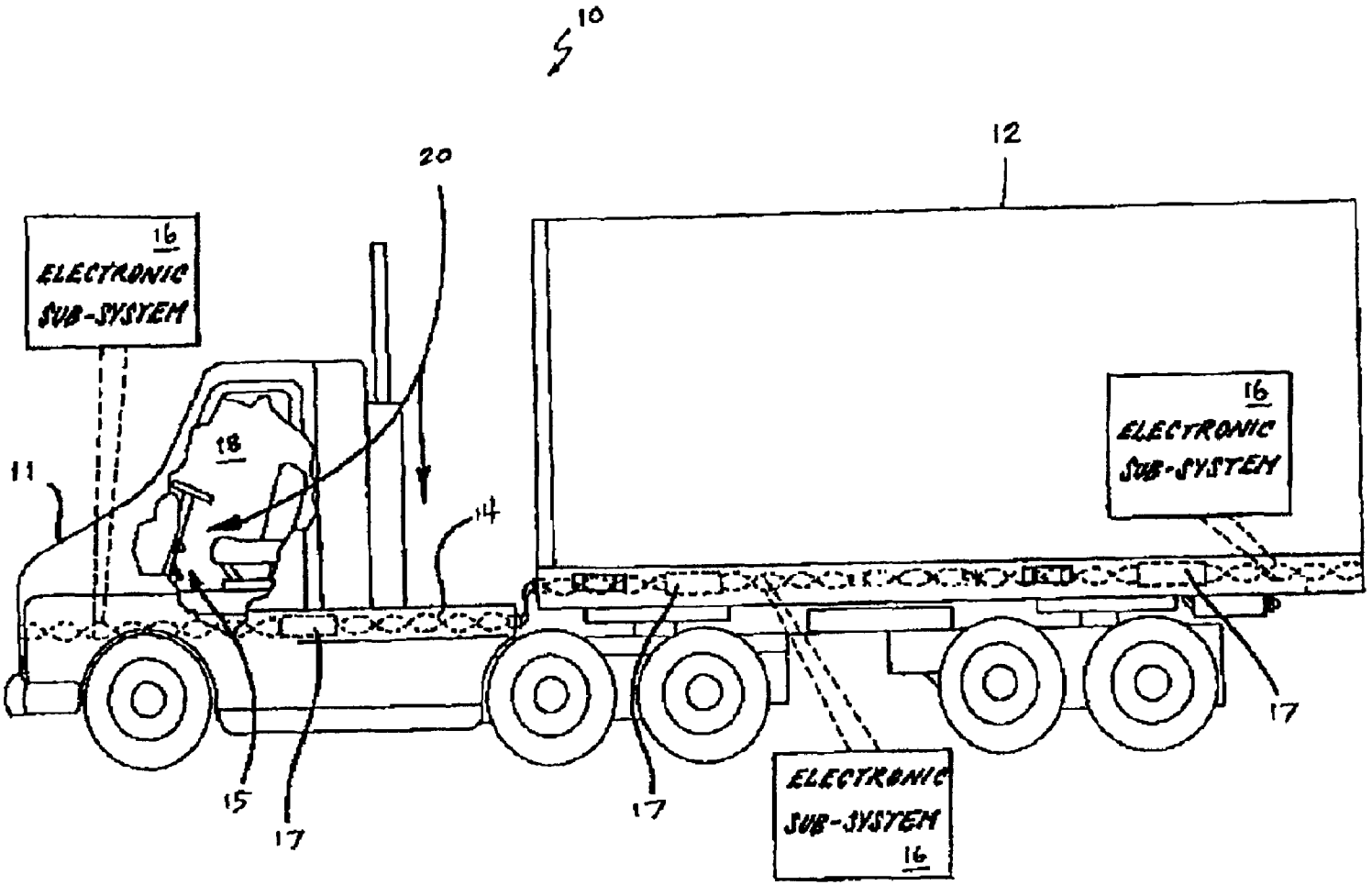
FIG. 1 is a schematic diagram of a vehicle in the form of a heavy duty vehicle, namely, a tractor and trailer combination, having an apparatus for enhanced data communication in accordance with an embodiment of the present invention.

FIG. 1 is a diagram of a vehicle in the form of a heavy duty vehicle, namely, a tractor and trailer combination, having a data communication system in accordance with an embodiment of the present invention. As shown, a heavy-duty vehicle such as a tractor-trailer combination 10 can include a tractor 11 and a trailer 12. Each of the tractor 11 and the trailer 12 preferably include respective frames and couplers for mechanically coupling to each other. An engine (not shown), such as a diesel engine, is provided within the tractor 11 for moving the tractor 11 and thereby pulling the trailer 12.

The tractor-trailer combination 10 also preferably includes various electronic subsystems 16. For example, the tractor 11 can include electronic subsystems such as an anti-locking brake system ("ABS"), a data communication system, a fuel monitoring system, and an engine power monitoring system as understood by those skilled in the art. The trailer 12 can include electronic subsystems such as a weight detection system, a trailer power monitoring system, a refrigeration system, an ABS, and a backup data communication system, such as understood by those skilled in the art. Other examples of these electronic subsystems 16 and features which can be monitored and/or controlled by the apparatus of the present invention are illustrated, but not limited to, for a tractor/trailer combination in Table I, for an agricultural tractor in Table II, and for a sedan or automobile type vehicle in Table III below:

TABLE I

| TRACTOR | TRAILER |
|---|---|
| Minor Tracking | Reefer Temperatures |
| Mirror with Trailer Display | Reefer Pressures |
| Controls for Reefer (Engine) | Trailer Identification |
| Controls for Trailer Slide | Blind Spot Warning |
| Axle | Cargo Information |
| Controls for Landing Gear | Smoke/Fire Detection |
| Active Faring | Overall (Tanker) |
| Recording for Trailer Functions | Cargo Shift |
| Satellite for Trailer Functions | Weight Detection |
| Brake System Information | Anti Lock Failure |
| Brake by Wire | Brake by Wire |
| Climate Controls for Reefer | Backup Lamps |
| | Suspension Control |
| | Sliding Axle Control |
| | Liftable Tailgate |
| | Time Pressure Monitor |
| | Lamp Outage Monitor |
| | Stop Lamp Saver (with doubles and triples) |
| | Water in Air Reservoir |
| | Liftable Landing Gear |
| | Brake Temperature |
| Mirror with Trailer Display | Emergency Line Pressure Detection |
| Trailer Identification | |
| Trailer Brake Temperature | Blind Spot Warning |
| Trailer Axle Temperatures | Cargo Information |
| Trailer Security | Time Pressure Warning |
| Weight Broadcast | Smoke Detector |
| Trailer Voltage Status | Roll Over Protection |
| | Active Conspicuity (Lighting) |
| | Active Tire Pressure |
| | Backup Alarm |
| | Inventory Data Control |
| | Security Warning |
| | Trailer Engine Start |
| | Trailer Engine Monitor |
| | Tractor/Changing from Reefer |
| | Trailer Dome Lamps |
| | Rear Door Lift (Motorized) |

TABLE II

| TRACTOR | IMPLEMENT |
|---|---|
| Vehicle Speed Optimization | Sprayer Pressure |
| Engine Speed Optimization | Speed Planning Rates |
| Implement Display | Depth Position |
| GPS (Satellite Control to Implement) | Hydraulic Controls |
| | Speed Counting |
| | Moisture Sensing |

TABLE III

| AUTOMOBILE OR SEDAN |
|---|
| Security |
| Engine Operations and Diagnostics |
| Lighting |
| Fuel Status |
| Battery Power |
| Emergency Functions |
| Acoustic and/or Video System Operations |
| GPS |
| On-Board Computer and/or Controller Operations |

The electronic subsystems 16 preferably are connected to each other via electrical conductors 14 such as twisted pair wire or other wiring standards or schemes. The electronic subsystems 16, for example, can be accessed through a connector 15 such as a six-pin Deutch connector or other well-known connectors used within tractor or trailer environments. The connector 15, for example, can be situated inside a cab 18 of the tractor 11 because the cab 18 can be secured via a lock and a vehicle alarm system. Also, the cab 18 is a convenient location for a driver or any authorized person to inspect the operational conditions of the tractor-trailer combination 10. Other locations, however, such as outside a vehicle such as the tractor or the trailer, e.g., in a light housing, on a door, on a window, or on an outer body surface of the vehicle, and inside a vehicle, e.g., under a hood, within a door or truck of a vehicle, within a body portion of a vehicle, or within the dashboard of a vehicle, can be used as well according to the present invention. The apparatus and methods described herein allow remote data communications and control terminal to communicate directly and control the electronic subsystem of the vehicle remotely such as those listed in Tables I–III above, as well as functions on applications such as ejector cut out, engine off or on, door locks, PTO cut out, RPM control, speed control, alternator settings, battery disconnect, battery connect, climate control settings, road speed settings, and governor speed control. In other words, the vehicle can be remotely controlled to select certain procedures, such as engine idle control for the sleeper by only having a temperature sensor in the bunk. The control is on the remote terminal such as a main server at fleet headquarters. The apparatus and methods allow many control products for the vehicle with only having a communications transceiver such as WIFI with input/output at the vehicle and many subsystems can then be remote. The vehicle or the driver, for example, will never know the difference because control, monitoring, communications can be accomplished remotely so that the functions are somewhat transparent to the vehicle operations. It will be understood by those skilled in the art that by opening windows at an IN data communication channel and compensating for time delay by storing received communication in a buffer prior to transmitting an electronic subsystem enhances data communication control by allowing remote terminal to communicate directly with a selected electronic subsystem and send command signals or instruction directly to real time to the vehicle.

Controllers 17 are preferably connected to the electrical conductors 14 to control data communications among the electronic subsystems 16. Each of the controllers 17 preferably includes a microprocessor operating under stored program designed to perform various functions related to the monitor and/or control of the electronic subsystems 16 within the tractor-trailer combination 10. The electronic subsystems also can advantageously communicate with each other through various types of communication technology, including power line carrier ("PLC") technology, infrared technology, radio frequency technology, and other communications technologies as well understood by those skilled in the art. Each of the electronic subsystems 16 to be monitored and/or controlled preferably includes a signal generator connected to a respective one of the controllers 17 for generating a signal related to the operation of a vehicle such as the tractor-trailer combination 10. For example, each of the controllers 17 can generate a number of output control signals in the form of relay contact closures or other signals to a respective one of the electronic subsystems 16. An apparatus and method for enhanced data communication and control between a vehicle and a remote data terminal is provided so that the present invention can allow vehicle electronic subsystems to be controlled remotely from a remote data communications terminal by providing real time monitoring of the electronic control systems and allow the remote terminal to respond to the functions and operations related to the vehicle.

Figure 2:
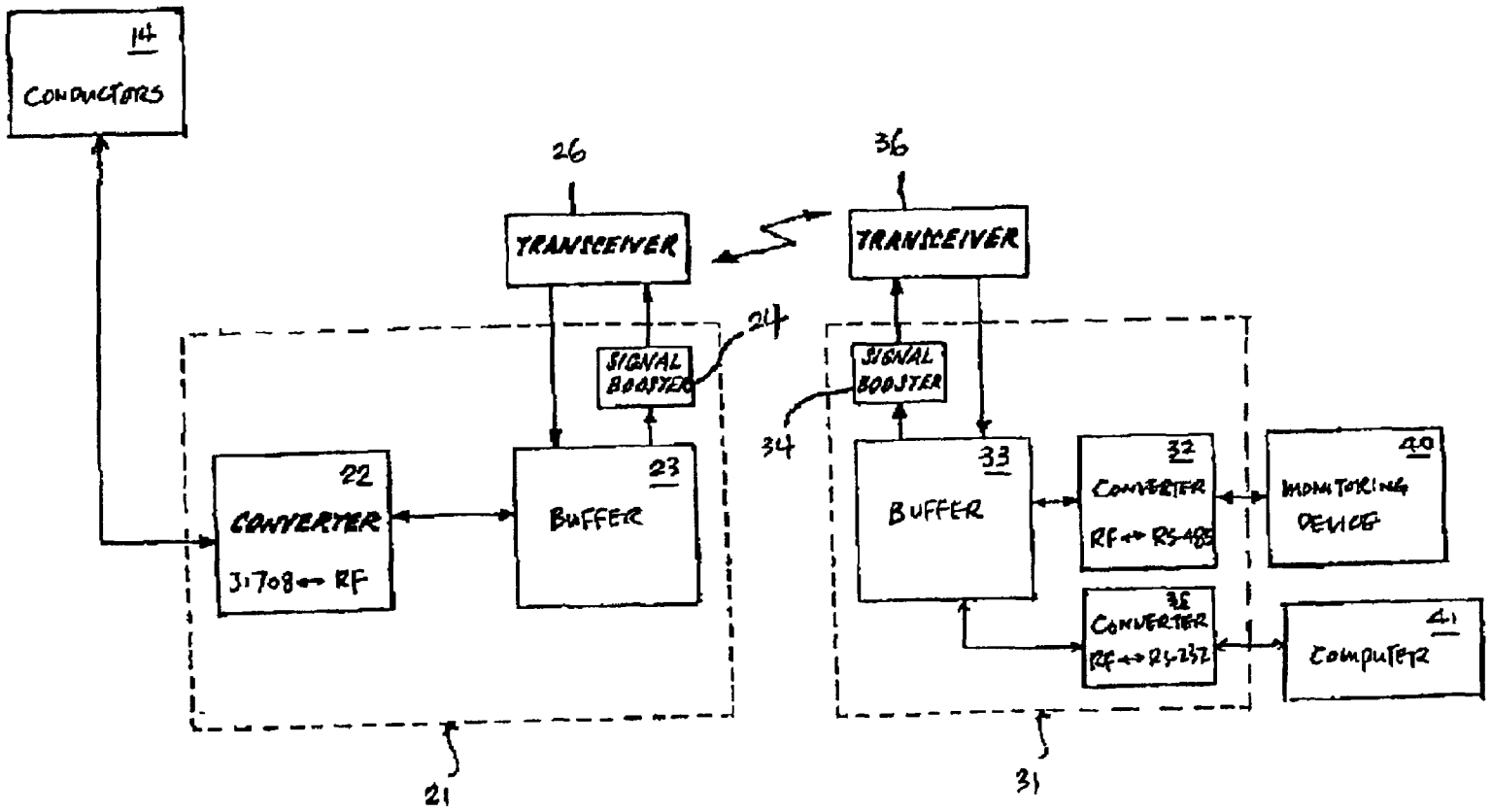
FIG. 2 is a block diagram of an apparatus for enhanced data communications wirelessly between a vehicle and a remote data communications terminal in accordance with an embodiment of the present invention.

A data communication apparatus 20 can be utilized to provide wireless communications such as between the tractor-trailer combination 10 traveling on the road and a data communications terminal or system located at a remote location away from the vehicle. The remote location, for example, can be a weigh station, a fuel distribution station, an office building, a warehouse, a retail store, a home, or another vehicle. FIG. 2 is a block diagram of the data communication apparatus 20 utilized to provide data communications wirelessly between the tractor-trailer combination 10 and a remote data communications terminal located at a remote location, in accordance with an embodiment of the present invention. As shown, the data communication apparatus 20 preferably has a vehicle data communication protocol converter 21 associated with a vehicle and a remote data communication protocol converter 31 associated with a remote data communications terminal. The vehicle data communication protocol converter 21 is preferably connected to, or in communication with, the tractor-trailer combination 10 in the illustrated example, and the remote data communication protocol converter 31 is connected to, or in communication with, a remote data communications terminal.

The vehicle data communication protocol converter 21 preferably includes a protocol converter 22, a buffer 23 in communication with the protocol converter 22, and a signal booster 24 in communication with the buffer 23. Connected to the electrical conductors 14, e.g., twisted pair, the protocol converter 22 converts data of a first data communication protocol utilized by data communications along the electrical conductors 14 to data of a second data communication protocol to be stored in the buffer 23. The first data communication protocol is preferably one of the data communication protocols conventionally associated with a vehicle environment, such as the standards promulgated by the Society of Automotive Engineering (SAE), including, but not limited to, SAE J1708 or SAE J1939. The second data communication protocol is preferably a wireless data communication protocol. In other words, the second data communication protocol is an over-the-air or through-the-air type of data communication protocol that does not require any component to be directly coupled from the remote data communications terminal to the tractor-trailer combination 10 during data transmissions as understood by those skilled in the art. As such, the second data communication protocol, for example, can be a radio frequency (RF) data communication protocol, an infrared (IR) data communication protocol, a satellite data communication protocol, or a microwave or other high frequency data communication protocol. Other over-the-air data communication protocols can be used as well as understood by those skilled in the art. The RF data communication protocol, for example, can be a simple modulation scheme or a complex protocol such as CEBus, as understood by those skilled in the art. For example, the RF data communication protocol can be a wireless transmission protocol according to the IEEE 802.11b standard, or otherwise known as the Wireless Fidelity (Wi-Fi) standard, as understood by those skilled in the art, all of which are incorporated herein by reference in their entireties. Other RF data communication protocols, for example, that can be used in the present invention as well include Bluetooth, 900 MegaHertz, and other RF data communication protocols as understood by those skilled in the art.

In the illustrated embodiment, the protocol converter 22 can include one or more microprocessors and/or microcontrollers connected to an RS-485 transceiver that transmits and receives logic level signals and an RF or, Wi-Fi, or 802.11 compliant integrated circuit, for example, as understood by those skilled in the art. The RF compliant integrated circuit can include the microprocessor or microcontroller, but can also be a separate device. The transceiver 26 is preferably a physical layer signal communications transceiver which has a transmitting portion and a receiving portion. A signal booster 24 can be incorporated in the transmission path from the protocol converter 22 to the transceiver 26. By having amplification circuitry and/or power boosting circuitry, the signal booster 24 can advantageously boosts transmission signals from the transceiver 26 such that the transmission range of the transceiver 26 can be increased or the power or the strength of the signal is increased.

The remote data communication protocol converter 31 preferably includes a protocol converter 32, a buffer 33 in communication with the protocol converter 32, and a signal booster 34 in communication with the buffer 33. The protocol converter 32 converts data of the second data communication protocol to data of a third data communication protocol to be used by a remote data communications terminal such as a monitoring device 40 or a computer 41. In the present example, the protocol converter 32 is a transceiver that transmits/receives data of the second data communication protocol to/from the buffer 33, or directly from a remote terminal. The data of the second data communication protocol, which is in accordance with the above-mentioned RF data communication protocol, is placed in the buffer 33 by the transceiver 36 when receiving data, and, if desired, from the remote terminal when transmitting data. The protocol converter 32 then transmits/receives data of the third data communication protocol to/from the monitoring device 40, e.g., a computer, an electronic display device, or other remote data communications terminal as understood by those skilled in the art. The third data communication protocol is preferably an RS-485 protocol (which advantageously has substantially the same characteristics as the SAE J1708 protocol). In addition, a protocol converter 35 can be used to transmit/receive data to/from the computer 41 according to the RS-232 protocol. The computer 41, for example, can be a portable computer, a handheld computer, or a substantially stationary data communications system. Although the third data communication protocol is shown to be RS-485 or RS-232, other similar data communication protocols such as RS-422 and RS-423 can also be used, as understood by those skilled in the art.

The transceiver 36 is preferably a physical layer signal communications transceiver. A signal booster 34 is incorporated in the transmission path from the protocol converter 32 to the transceiver 36. By having amplification circuitry and/or power boosting circuitry, the signal booster 34 can advantageously boost the transmission signal from the transceiver 36 such that the transmission range of the transceiver 36 can be enhanced. The protocol converters 32, 35 can also include one or more microprocessors and/or microcontrollers connected to a transceiver and an RF, Wi-Fi, or 802.11 compliant integrated circuit provided by, for example, as understood by those skilled in the art.

Figure 3:
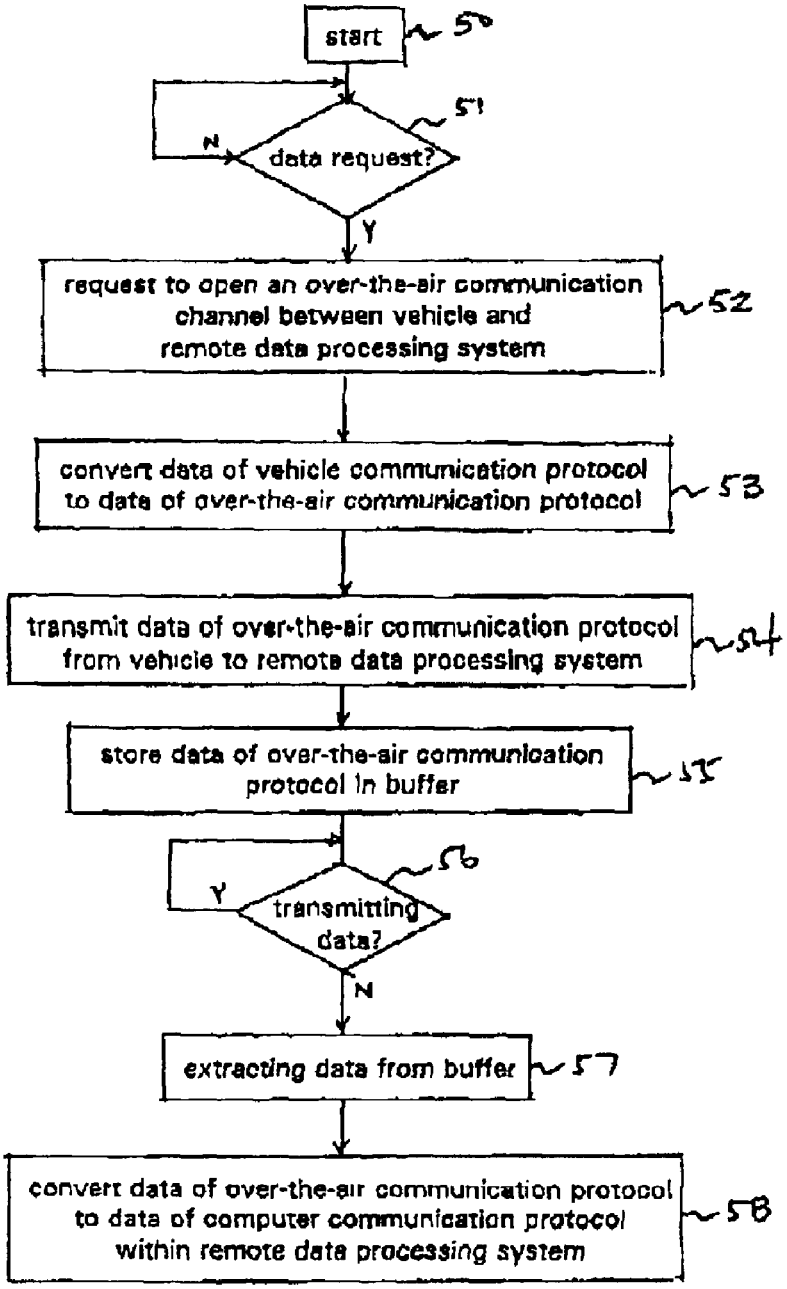
FIG. 3 is a flow diagram of a method for enhanced data communications between a vehicle and a remote data communications terminal, in accordance with an embodiment of the present invention.

FIG. 3 is a flow diagram of a method for providing data communications between a vehicle, such as the tractor-trailer combination 10, and a remote data communications terminal, such as the monitoring device 40, in accordance with a preferred embodiment of the present invention. Starting at block 50, the vehicle (or the remote terminal) preferably is "listening" for a data request from the remote data communications terminal (or from the vehicle), as shown in block 51. After a data request has been received, the vehicle then requests to open a window in an over-the-air communication channel between the vehicle and the remote data communications terminal, as depicted in block 52. Such request is made through a requestor that can be implemented via software or hardware at each of the vehicle and the remote data communication terminal. In the present example, the requestor is preferably implemented in software capable of opening a window in an over-the-air communication channel in accordance with the IEEE 802.11b standard mentioned previously. The software and command sequence for this to occur is specified in the IEEE 802.11b standard and is well understood by those skilled in the art.

Next, data of a local-area vehicle communication protocol (i.e., SAE J1708) is converted to data of an over-the-air communication protocol (i.e., RF data communication protocol) within the vehicle, as shown in block 53. The data of the over-the-air communication protocol is then wirelessly transmitted from a transceiver within the vehicle to a transceiver within the remote data communications terminal through the air, as depicted in block 54. The data of the over-the-air communication protocol is then stored in a buffer within the remote data communications terminal, as shown in block 55. A determination is then made as to whether the remote data communications terminal is transmitting data at the time, as depicted in block 56. If the remote data communications terminal is not transmitting data, the data stored in the buffer can be extracted from or transferred from the buffer for further processing, as shown in block 57. Otherwise, if the remote data communications terminal is transmitting data, the data stored in the buffer remains in the buffer until the data transmission from the remote data communications terminal has been completed or until an idle period occurs in the midst of the data transmission (see FIG. 4). Because a window is open in the data communication channel, SAE J1708 data is passed directly via an over-the-air media to the remote terminal where is converted from the through-the-air protocol directly to a data protocol that is basically equivalent to the SAE J1708, such as RS-485. The RS-485 data, in essence, is a replica of the data on the vehicle, e.g., in a similar format, and thereby electronic subsystems of the vehicle can then be directly observed, monitored, diagnosed, or impacted by interaction with the remote terminal. One major difference, however, is the time delay involved in this over-the-air transfer or direct communication of the vehicle data. Nevertheless, this buffer and time delay scheme of the present invention advantageously allows the time delay to be compensated for by substantially reducing the risk that either the vehicle or the remote terminal will be trying to communicate with or transmit to the other when, instead, it should be listening for or receiving data. The completion of a data transmission is commonly signified by one or more end-of-transmission (EOT) characters that are well-known in the art. The data of the over-the-air communication protocol are subsequently converted to data of a computer communication protocol (i.e., RS-485) within the remote data communications terminal, as depicted in block 58.

Although the data received from over-the-air is shown to be stored in the buffer before protocol conversion is performed on the data, it is understood by those skilled in the art that the protocol conversion can be performed on the data received from over-the-air before storing the data in the buffer.

Figure 4:
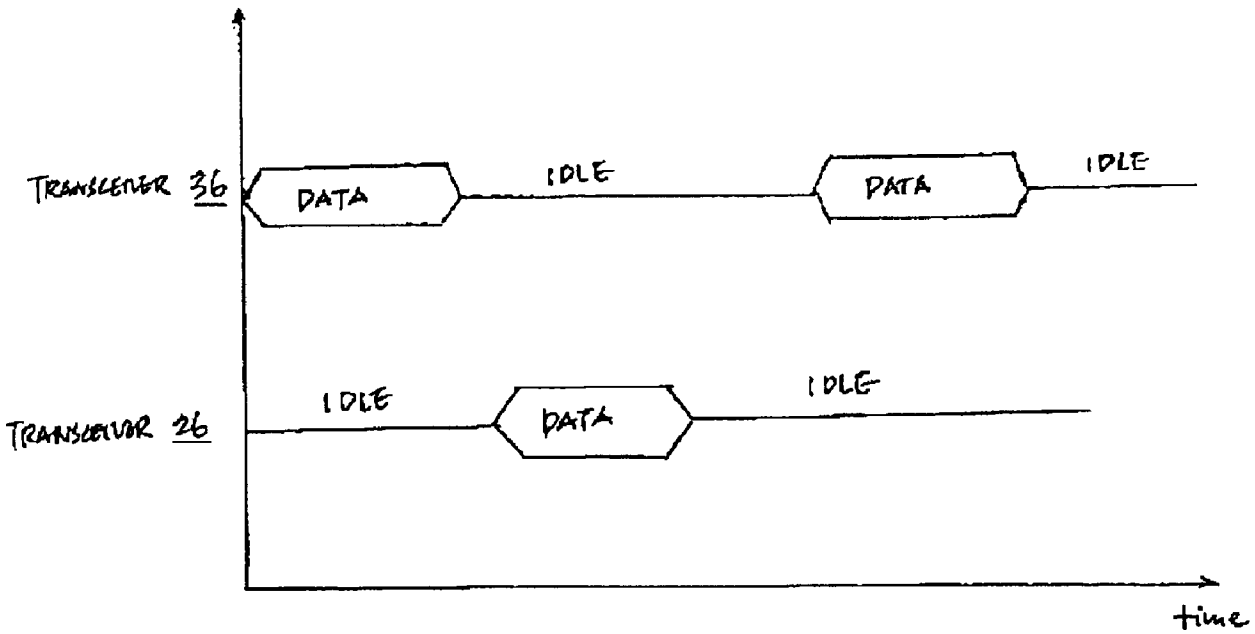
FIG. 4 is a timing graph or diagram depicting the data transmission from a first transceiver in a vehicle to a second transceiver in the remote data communications terminal of an apparatus for enhanced data communications, in accordance with an embodiment of the present invention.

In addition, the transceiver 26 begins to transmit data only when the remote data communications terminal is not transmitting data at the same time. The transceiver 26 does not transmit data until the data transmission from the remote data communications terminal to the transceiver 26 has been completed or until an idle period occurs in the midst of the data transmission, as shown in FIG. 4. Even if more data is received when either the vehicle or the remote terminal is transmitting, for example, the buffer advantageously allows the data to be captured and not lost in the communication sequence or cycle. The buffer then merely waits to makes sure that transmission has finished. The transfer from the buffer to the electronic subsystem then happens relatively instantaneously without any significant time delay as understood by those skilled in the art. In this manner, critical signals, status, or other functions are not missed in the communication sequence or cycle.

As illustrated and described, the first protocol converter of the apparatus preferably converts the vehicle data communication protocol to an over-the-air data communication not having the over-the-air communication protocol when the over-the-air communication window is open in the over-the-air data communication channel so that the over-the-air communication passes to the second transceiver and the second protocol converter converts the over-the-air communication to the remote terminal data communication protocol. The remote terminal data communication protocol, e.g., RS-485, preferably is substantially the same as the vehicle data communication protocol, e.g., RS-232, so that the converted over-the-air communication after received by the second transceiver is readily recognized by the remote data communication terminal.

Likewise, the first buffer responsively receives an acknowledgment from the first transceiver communicating that the first transceiver has completed the over-the-air communication prior to transferring received data from the first buffer to the at least one electronic subsystem to thereby compensate for time delay associated with the received data. Also, the second buffer responsively receives an acknowledgement from the second transceiver communicating that the second transceiver has completed the over-the-air communication prior to transferring received data from the second buffer to the remote data communication terminal to thereby compensate for time delay associated with the received data. Accordingly, as illustrated and described, although both the vehicle and the remote terminal preferably have a requestor and a buffer, it will be understood by those skilled in the art that only one of the vehicle or the remote terminal need to have these additional features according to the present invention, including the methods as described further herein below.

As illustrated in FIGS. 1–4, the present invention also advantageously provides methods for enhanced data communications between a vehicle and a remote data communications terminal. A method preferably includes requesting an opening of a window in an over-the-air communication channel between a vehicle and a remote data communication terminal, wirelessly transmitting data substantially devoid of the over-the-air communication protocol from the vehicle to the remote data communication terminal during the open window in the over-the-air communication channel, temporarily storing data received by the remote data communication terminal, and transferring the temporarily stored data to other portions of the remote data communication terminal responsive to an acknowledgement that the remote data communications terminal is not transmitting any data to the vehicle. The method can also include boosting power for the over-the-air data being transmitted during the open window in the over-the-air communication channel from the vehicle to the remote data communications terminal.

Another method for enhanced data communications between a vehicle and a remote data communications terminal preferably includes requesting to open a window in an over-the-air communication channel between a remote data communication terminal and a vehicle, wirelessly transmitting data substantially devoid of the over-the-air communication protocol from the remote data communication terminal to the vehicle during the open window in the over-the-air communication channel, temporarily storing data received by the vehicle, and transferring the temporarily stored data received by the vehicle to an electronic subsystem associated with the vehicle responsive to an acknowledgement that the vehicle is not transmitting any data to the remote data communications terminal. This method can also include boosting power for the over-the-air data being transmitted during the open window in the over-the-air communication channel from the remote data communications terminal to the vehicle.

According to an embodiment of the present invention, a computer program product can also be provided which resides on a computer usable medium for providing data communications between an electric subsystem of a vehicle and a remote data communication terminal. The computer program product preferably is software as understood by those skilled in the art which preferably resides on a vehicle or on a remote data communication terminal or, perhaps more preferably, portions on a vehicle and portions on a remote data communications terminal. The computer program product preferably includes converting means, e.g., preferably provided by a first and/or a second protocol converter formed of a software, adapted to be positioned in communication with an electronic subsystem of a vehicle for converting data from a vehicle communication protocol to data of an over-the-air communication protocol. The computer program product also preferably includes requesting means, e.g., preferably provided by a first and/or a second requestor formed of software, responsive to the converting means for requesting an opening of a window in an over-the-air communication channel between the vehicle and a remote data communications terminal to wirelessly transmit data from either the vehicle to a remote data communication terminal or from the remote data communication terminal to the vehicle, and transferring means, e.g., preferably provided by a first and/or second buffer former of software, responsive to an acknowledgment for transferring data received from the remote data communication terminal to at least one electronic subsystem of the vehicle when the vehicle is not transmitting data to the remote data communication terminal. Also, either in combination or alternatively, the transferring means can be responsive to an acknowledgement for transferring data received from the vehicle to other portions of the remote data communications terminal when the remote data communications terminal is not transmitting data to the vehicle.

As has been described, the present invention provides an apparatus and method for providing data communications between a vehicle and a remote data communications terminal. It is understood by those skilled in the art that the present invention can be utilized by any type of vehicle, including passenger vehicles such as automobiles, sedans, sports utility vehicles, trucks, boats, military vehicles, and is particularly advantageous with heavy-duty vehicles such as tractor and/or trailer combinations, recreational vehicles, agricultural tractors, transportation vehicles, etc.

It is also important to note that although the present invention has been described in the context of a fully functional data communications system, those skilled in the art will appreciate that the mechanisms of the present invention are capable of being distributed as a program product in a variety of forms, and that the present invention applies equally regardless of the particular type of signal bearing media utilized to actually carry out the distribution. Examples of signal bearing media include, without limitation, recordable type media such as floppy disks or CD ROMs and transmission type media such as analog or digital communications links.

Although the invention has been particularly shown and described with reference to an illustrated embodiment, it will be understood by those skilled in the art that various changes in form and detail may be made therein without departing from the spirit and scope of the invention.

That claimed is:

1. An apparatus for enhanced data communications between a vehicle and a remote data communication terminal, the apparatus comprising:

a first protocol converter associated with a vehicle, adapted to be positioned in communication with at least one electronic subsystem of the vehicle, and positioned to convert data from a vehicle communication protocol to data of an over-the-air communication protocol;

a first requestor associated with the vehicle and positioned to request the opening of an over-the-air communication window in a data communication channel between the vehicle and a remote data communication terminal using the over-the-air communication protocol;

a first transceiver associated with the vehicle and in communication with the first requestor to wirelessly transmit data over-the air to the remote data communication terminal and to wirelessly receive data over-the-air from the remote data communication terminal;

a first buffer associated with the vehicle, in communication with the first transceiver and the first protocol converter to receive and temporarily store data communication received from the first transceiver, and positioned to transfer the received data to the first protocol converter and to at least one electronic subsystem when the first transceiver is not transmitting data communication therefrom;

a second transceiver associated with the remote data communication terminal to wirelessly receive data over-the-air from the vehicle and wirelessly transmit data over-the-air to the vehicle;

a second protocol converter associated with the remote data communication terminal and in communication with the second transceiver to convert the received data from the over-the-air communication protocol to a remote terminal communication protocol during the open over-the-air window in the over-the-air communication channel;

a second requestor associated with the remote data communication terminal and positioned to request the opening of a window in the data communication channel between the remote data communication terminal and the vehicle using the over-the-air communication protocol; and a second buffer associated with the remote data communication terminal, in communication with the second transceiver and the second protocol converter to receive and temporarily store data communication received from the second transceiver, and positioned to transfer data to the second protocol converter and the remote data communication terminal when the second transceiver is not transmitting data therefrom.

2. An apparatus as defined in claim 1, wherein the first protocol converter converts the vehicle data communication protocol to an over-the-air data communication not having the over-the-air communication protocol when the over-the-air communication window is open in the over-the-air data communication channel so that the over-the-air communication passes to the second transceiver and the second protocol converter converts the over-the-air communication to the remote terminal data communication protocol, the remote terminal data communication protocol being substantially the same as the vehicle data communication protocol so that the converted over-the-air communication after received by the second transceiver is readily recognized by the remote data communication terminal.

3. An apparatus as defined in claim 2, wherein the first buffer responsively receives an acknowledgment from the first transceiver communicating that the first transceiver has completed the over-the-air communication prior to transferring received data from the first buffer to the at least one electronic subsystem to thereby compensate for time delay associated with the received data, and wherein the second buffer responsively receives an acknowledgement from the second transceiver communicating that the second transceiver has completed the over-the-air communication prior to transferring received data from the second buffer to the remote data communication terminal to thereby compensate for time delay associated with the received data.

4. An apparatus as defined in claim 3, further comprising a first signal booster in communication with the first protocol converter and the first transceiver and associated with the vehicle to boost the power of data communication being transmitted with second data communication protocol to the remote data communication terminal, and a second signal booster in communication with the second protocol converter and the second transceiver and associated with the remote data communication terminal to boost the power of data communication being transmitted with the second data communication protocol to the vehicle, wherein the vehicle communication protocol comprises the SAE J1708 standard protocol, and wherein the remote terminal communication protocol comprises the RS-485 standard protocol.

5. An apparatus as defined in claim 1, wherein the over-the-air communication protocol comprises at least one of the following: a radio frequency communication protocol, an optical communication protocol, a microwave communication protocol, a satellite frequency communication protocol, a very high frequency communication protocol, an ultra-high frequency communication protocol, and an infrared communication protocol.

6. An apparatus as defined in claim 1, wherein the vehicle data communication protocol comprises at least one of the following: SAE J1708 and SAE J1939, and wherein the remote terminal communication protocol comprises at least one of the following: the RS-485 standard, RS-232 standard, RS-422 standard, and RS-423 standard.

7. An apparatus for enhanced data communications between a vehicle and a remote data communication terminal, the apparatus comprising:

a first protocol converter associated with a vehicle, adapted to be positioned in communication with at least one electronic subsystem of the vehicle, and positioned to convert data from a vehicle communication protocol to data of an over-the-air communication protocol;

a requestor associated with the vehicle and positioned to request the opening of an over-the-air communication window in a data communication channel between the vehicle and a remote data communication terminal using the over-the-air communication protocol;

a first transceiver associated with the vehicle and in communication with the requestor to wirelessly transmit data over-the air to the remote data communication terminal and to wirelessly receive data over-the-air from the remote data communication terminal;

a buffer associated with the vehicle, positioned to receive and temporarily store data communication received from the first transceiver, and positioned to transfer the received data to the at least one electronic subsystem when the first transceiver is not transmitting data communication therefrom;

a second transceiver associated with the remote data communication terminal to wirelessly receive data over-the-air from the vehicle and wirelessly transmit data over-the-air to the vehicle; and a second protocol converter associated with the remote data communication terminal and in communication with the second transceiver to convert the received data from the over-the-air communication protocol to a remote terminal communication protocol during the open over-the-air window in the over-the-air communication channel.

8. An apparatus as defined in claim 7, wherein the first protocol converter converts the vehicle data communication protocol to an over-the-air data communication not having the over-the-air communication protocol when the over-the-air communication window is open in the over-the-air data communication channel so that the over-the-air communication passes to the second transceiver and the second protocol converter converts the over-the-air communication to the remote terminal data communication protocol, the remote terminal data communication protocol being substantially the same as the vehicle data communication protocol so that the converted over-the-air communication after received by the second transceiver is readily recognized by the remote data communication terminal.

9. An apparatus as defined in claim 8, wherein the buffer responsively receives an acknowledgment from the first transceiver communicating that the first transceiver has completed the over-the-air communication prior to transferring received data from the first buffer to the at least one electronic subsystem to thereby compensate for time delay associated with the received data.

10. An apparatus as defined in claim 9, further comprising a first signal booster in communication with the first protocol converter and the first transceiver and associated with the vehicle to boost the power of data communication being transmitted with second data communication protocol to the remote data communication terminal, and a second signal booster in communication with the second protocol converter and the second transceiver and associated with the remote data communication terminal to boost the power of data communication being transmitted with the second data communication protocol to the vehicle, wherein the vehicle communication protocol comprises the SAE J1708 standard protocol, and wherein the remote terminal communication protocol comprises the RS-485 standard protocol.

11. An apparatus as defined in claim 7, wherein the over-the-air communication protocol comprises at least one of the following: a radio frequency communication protocol, an optical communication protocol, a microwave communication protocol, a satellite frequency communication protocol, a very high frequency communication protocol, an ultra-high frequency communication protocol, and an infrared communication protocol.

12. An apparatus as defined in claim 7, wherein the vehicle data communication protocol comprises at least one of the following: SAE J1708 and SAE J1939, and wherein the remote terminal communication protocol comprises at least one of the following: the RS-485 standard, RS-232 standard, RS-422 standard, and RS-423 standard.

13. An apparatus for enhanced data communications between a vehicle and a remote data communication terminal, the apparatus comprising:

a first protocol converter associated with a vehicle, adapted to be positioned in communication with at least one electronic subsystem of the vehicle, and positioned to convert data from a vehicle communication protocol to data of an over-the-air communication protocol;

a first transceiver associated with the vehicle and in communication with the first protocol converter to wirelessly transmit data over-the air to the remote data communication terminal and to wirelessly receive data over-the-air from the remote data communication terminal;

a second transceiver associated with the remote data communication terminal to wirelessly receive data over-the-air from the vehicle and wirelessly transmit data over-the-air to the vehicle;

a second protocol converter associated with the remote data communication terminal and in communication with the second transceiver to convert the received data from the over-the-air communication protocol to a remote terminal communication protocol;

a requestor associated with the remote data communication terminal and positioned to request the opening of an over-the-air window in the data communication channel between the remote data communication terminal and the vehicle using the over-the-air communication protocol; and a buffer associated with the remote data communication terminal, positioned to receive and temporarily store data communication received from the second transceiver, and positioned to transfer data to the remote data communication terminal when the second transceiver is not transmitting data therefrom.

14. An apparatus as defined in claim 13, wherein the second protocol converter converts the vehicle data communication protocol to an over-the-air data communication not having the over-the-air communication protocol when the over-the-air communication window is open in the over-the-air data communication channel so that the over-the-air communication passes to the first transceiver and the first protocol converter converts the over-the-air communication to the vehicle data communication protocol, the vehicle data communication protocol being substantially the same as the remote terminal data communication protocol so that the converted over-the-air communication after received by the first transceiver is readily recognized by the at least one electronic subsystem.

15. An apparatus as defined in claim 14, wherein the buffer responsively receives an acknowledgment from the second transceiver communicating that the second transceiver has completed the over-the-air communication prior to transferring received data from the buffer to other portions of the remote data communication terminal to thereby compensate for time delay associated with the received data.

16. An apparatus as defined in claim 15, further comprising a first signal booster in communication with the first protocol converter and the first transceiver and associated with the vehicle to boost the power of data communication being transmitted with the over-the-air data communication protocol to the remote data communication terminal, and a second signal booster in communication with the second protocol converter and the second transceiver and associated with the remote data communication terminal to boost the power of data communication being transmitted with the over-the-air data communication protocol to the vehicle, wherein the vehicle communication protocol comprises the SAE J1708 standard protocol, and wherein the remote terminal communication protocol comprises the RS-485 standard protocol.

17. An apparatus as defined in claim 13, wherein the over-the-air communication protocol comprises at least one of the following: a radio frequency communication protocol, an optical communication protocol, a microwave communication protocol, a satellite frequency communication protocol, a very high frequency communication protocol, an ultra-high frequency communication protocol, and an infrared communication protocol.

18. An apparatus as defined in claim 13, wherein the vehicle data communication protocol comprises at least one of the following: SAE J1708 and SAE J1939, and wherein the remote terminal communication protocol comprises at least one of the following: the RS-485 standard, RS-232 standard, RS-422 standard, and RS-423 standard.

19. A method for enhanced data communications between a vehicle and a remote data communications terminal, the method comprising:

requesting an opening of a window in an over-the-air communication channel between a vehicle and a remote data communication terminal;

wirelessly transmitting data substantially devoid of an over-the-air communication protocol from the vehicle to the remote data communication terminal during the open window in the over-the-air communication channel;

temporarily storing data received by the remote data communication terminal; and transferring the temporarily stored data to other portions of the remote data communication terminal responsive to an acknowledgement that the remote data communications terminal is not transmitting any data to the vehicle.

20. A method as defined in claim 19, further comprising boosting power for the over-the-air data being transmitted during the open window in the over-the-air communication channel from the vehicle to the remote data communications terminal.

21. A method for enhanced data communications between a vehicle and a remote data communications terminal, the method comprising:

requesting to open a window in an over-the-air communication channel between a remote data communication terminal and a vehicle;

wirelessly transmitting data substantially devoid of an over-the-air communication protocol from the remote data communication terminal to the vehicle during the open window in the over-the-air communication channel;

temporarily storing data received by the vehicle; and transferring the temporarily stored data received by the vehicle to an electronic subsystem associated with the vehicle responsive to an acknowledgement that the vehicle is not transmitting any data to the remote data communications terminal.

22. A method as defined in claim 21, further comprising boosting power for the over-the-air data being transmitted during the open window in the over-the-air communication channel from the remote data communications terminal to the vehicle.

23. A method for enhanced data communications and control between a vehicle and a remote data communications terminal, the method comprising:

requesting to open a window in an over-the-air communication channel between a remote data communication terminal and a vehicle;

wirelessly transmitting data substantially devoid of an over-the-air communication protocol from the remote data communication terminal to the vehicle during the open window in the over-the-air communication channel;

temporarily storing data received by the vehicle;

transferring the temporarily stored data received by the vehicle to an electronic subsystem associated with the vehicle responsive to an acknowledgement that the vehicle is not transmitting any data to the remote data communications terminal;

Receiving the temporarily stored data by the electronic subsystem of the vehicle and responsively changing the condition of the vehicle thru the electronic subsystem by the received data.

24. A computer program product residing on a computer usable medium for providing data communications between an electric subsystem of a vehicle and a remote data communication terminal, the computer program product comprising:

converting means adapted to be positioned in communication with an electronic subsystem of a vehicle for converting data from a vehicle communication protocol to data of an over-the-air communication protocol;

requesting means responsive to the converting means for requesting an opening of a window in an over-the-air communication channel between the vehicle and a remote data communications terminal to wirelessly transmit data from the vehicle to a remote data communication terminal; and transferring means responsive to an acknowledgment for transferring data received from the remote data communication terminal to at least one electronic subsystem of the vehicle when the vehicle is not transmitting data to a remote communication terminal.

* * * * *